US009785087B2

(12) United States Patent
Gofuku et al.

(10) Patent No.: US 9,785,087 B2
(45) Date of Patent: Oct. 10, 2017

(54) DEVELOPER CONTAINER, DEVELOPING APPARATUS, PROCESS CARTRIDGE, AND IMAGE FORMING APPARATUS

(71) Applicant: CANON KABUSHIKI KAISHA, Tokyo (JP)

(72) Inventors: Shuichi Gofuku, Numazu (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/080,239

(22) Filed: Mar. 24, 2016

(65) Prior Publication Data

US 2016/0282764 A1 Sep. 29, 2016

(30) Foreign Application Priority Data

Mar. 27, 2015 (JP) ..... 2015-065556
Mar. 27, 2015 (JP) ..... 2015-065557

(51) Int. Cl.
*G03G 15/08* (2006.01)

(52) U.S. Cl.
CPC . *G03G 15/0882* (2013.01); *G03G 2215/0132* (2013.01); *G03G 2215/0687* (2013.01)

(58) Field of Classification Search
CPC ..... G03G 15/0898; G03G 15/0881; G03G 15/0882; G03G 15/0886; G03G 15/0841; G03G 2215/0687; G03G 2215/0132
USPC ..... 399/106, 105
See application file for complete search history.

(56) References Cited

U.S. PATENT DOCUMENTS

2013/0308971 A1* 11/2013 Kashiide ..... G03G 15/0882 399/106
2014/0363196 A1* 12/2014 Wada ..... G03G 15/0898 399/106

FOREIGN PATENT DOCUMENTS

JP 2013-257540 A 12/2013
JP 2014-112206 A 6/2014

* cited by examiner

*Primary Examiner* — Sophia S Chen
(74) *Attorney, Agent, or Firm* — Canon U.S.A. Inc., IP Division

(57) ABSTRACT

A frame including an opening and configured to store a developer, a seal member configured to seal the opening, and an unsealing member including a fixing portion to which the seal member is bonded or welded are included, and by movement of the unsealing member the seal member is removed from the frame to open the opening.

32 Claims, 13 Drawing Sheets

DEVELOPER CONTAINER, DEVELOPING APPARATUS, PROCESS CARTRIDGE, AND IMAGE FORMING APPARATUS

BACKGROUND OF THE INVENTION

Field of the Invention

The present invention relates to a developer container, a developing apparatus, a process cartridge, and an image forming apparatus.

As used herein, the term "developer container" refers to a container configured to store developer for use in an image forming apparatus.

As used herein, the term "developing apparatus" refers to a developing apparatus, including at least a developer container and a developer carrying member, configured to visualize an electrostatic latent image with developer.

As used herein, the term "process cartridge" refers to a process cartridge in which at least a developer container, a developer carrying member, and an image carrying member are integrated. The process cartridge is attachable to and detachable from an image forming apparatus.

As used herein, the term "image forming apparatus" refers to an image forming apparatus, including the developer container, configured to form an image on a recording medium such as a recording sheet by use of an image forming method. Examples of an image forming apparatus include copying machines, printers, facsimile apparatuses, multi-function printers, etc.

Description of the Related Art

Japanese Patent Application Laid-Open Nos. 2014-112206 and 2013-257540 discuss a configuration in which an opening of a container storing developer is sealed with a sealing member and the sealing member is removed with an unsealing shaft to unseal the opening. An end of the sealing member is attached to the unsealing shaft, so that the sealing member is spooled as the unsealing shaft starts rotating. As a result, the sealing member is unsealed at the use starting time of a developing apparatus. After the sealing member is unsealed, the sealing member continues rotating along with the unsealing shaft in the container. The foregoing configuration can prevent leakage of the developer caused by shaking or impact during the transportation of the process cartridge. Further, since the sealing member remains within the process cartridge, the user does not need to remove the sealing member before the use. Consequently, the usability is improved.

In the foregoing conventional techniques, the sealing member is spooled with the unsealing shaft at the start of the use of the developing apparatus, so that the sealing member is removed from the opening. When the sealing member is removed from the opening, a load is generated. The load at the time of the removal of the sealing member increases if a larger area of a seal portion of the sealing member fixed around the opening needs to be removed simultaneously. The developing apparatus is driven by driving force received from a motor of a main body of an image forming apparatus. Accordingly, when the load increases, the output of the motor needs to be increased. As a result, the size of the motor or in the cost may increase. In the conventional techniques, in order to decrease the area of the seal portion that is to be removed simultaneously, the shapes of the sealing member and the unsealing shaft are changed so that the removal is started at an end portion of the seal portion.

SUMMARY OF THE INVENTION

The present invention is directed to decreasing a load at removal of a seal member by starting the removal of the seal member at an end portion of a seal portion by use of a simpler configuration, which is developed from the conventional techniques described above.

According to an aspect of the present invention, a developer container includes a frame including an opening and configured to store a developer, a seal member configured to seal the opening, and an unsealing member including a fixing portion to which the seal member is bonded or welded. The unsealing member includes the fixing portion on both sides in a longitudinal direction thereof excluding on a center portion in a longitudinal direction thereof, and wherein, by movement of the unsealing member, the seal member is removed from the frame to unseal the opening.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings. It should be understood that dimensions, materials, and shapes of components, relative locations of the components, etc. that are described in the following exemplary embodiments may be changed as appropriate depending on the configuration of an apparatus to which an exemplary embodiment of the present invention is applied, various conditions, etc. Therefore, unless otherwise specified, it is not intended to limit the scope of the invention to those of the exemplary embodiments.

A first exemplary embodiment of the present invention will be described below. A process cartridge and an image forming apparatus including the process cartridge according to the present exemplary embodiment will be described below with reference to the drawings.

(Entire Configuration of Image Forming Apparatus)

Figure 2:
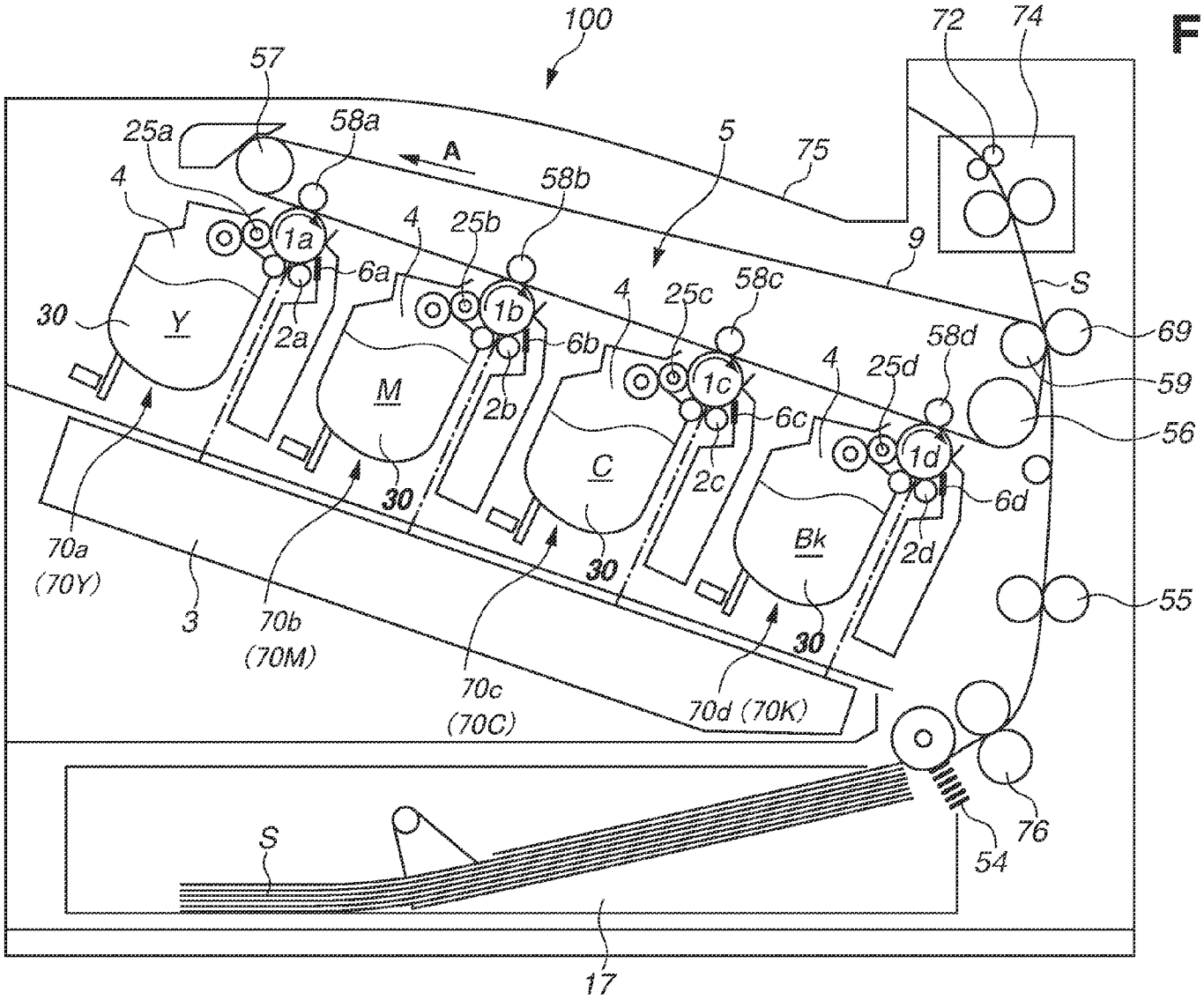
FIG. 2 is a main cross-sectional view illustrating an image forming apparatus according to the first exemplary embodiment.

First, the entire configuration of an electrophotographic image forming apparatus (hereinafter, "image forming apparatus") 100 will be described below with reference to FIG. 2. FIG. 2 illustrates the configuration of the image forming apparatus 100 to which process cartridges 70 according to the present exemplary embodiment are attached. In FIG. 2, the entire configuration of a full-color laser beam printer is illustrated as an example of the image forming apparatus 100.

As illustrated in FIG. 2, four process cartridges 70 (70Y, 70M, 70C, 70K) are attachable to and detachable from the image forming apparatus 100 by using an attachment member (not illustrated). Further, an upstream side in the direction in which the process cartridges 70 are attached to the image forming apparatus 100 is defined as a front side surface side, and a downstream side in the attachment direction is defined as a rear side surface side. In FIG. 2, the process cartridges 70 are attached inclined with respect to a horizontal direction in the image forming apparatus 100.

Each of the process cartridges 70 includes a photosensitive drum 1 (1*a*, 1*b*, 1*c*, 1*d*) and a process means, which are integrally disposed. The photosensitive drum 1 is an image carrying member configured to carry a developer image, and the processing means is configured to act on the photosensitive drum 1. In the present exemplary embodiment, a charging roller 2 (2*a*, 2*b*, 2*c*, 2*d*), a development roller 25 (25*a*, 25*b*, 25*c*, 25*d*), and a cleaning member 6 (6*a*, 6*b*, 6*c*, 6*d*) are integrally disposed as the processing means around the photosensitive drum 1.

The charging roller 2 is a charging means configured to uniformly charge a surface of the photosensitive drum 1. The development roller 25 is a developer carrying member included in a developing apparatus configured to develop with toner a latent image formed on the photosensitive drum 1 to visualize the latent image. The cleaning member 6 is a cleaning means configured to remove residual toner remaining on the photosensitive drum 1 after a toner image formed on the photosensitive drum 1 is transferred onto a recording medium S.

Further, a scanner unit 3 is provided below the process cartridges 70. The scanner unit 3 selectively performs exposure on the photosensitive drum 1 based on image information to form a latent image on the photosensitive drum 1.

A cassette 17 in which recording mediums S are stored is attached to a lower part of the image forming apparatus 100. Further, a recording medium conveying unit is provided to convey the recording mediums S to an upper part of the image forming apparatus 100 through a secondary transfer roller 69 and a fixing unit 74. More specifically, a sheet feeding roller 54, a conveying roller pair 76, and a registration roller pair 55 are provided. The sheet feeding roller 54 separates and feeds one by one the recording mediums S stored in the cassette 17. The conveying roller pair 76 conveys a fed recording medium S. The registration roller pair 55 is configured to synchronize a latent image formed on the photosensitive drum 1 with a recording medium S.

Further, an intermediate transfer unit 5 is provided over the process cartridges 70 (70*a*, 70*b*, 70*c*, 70*d*). The intermediate transfer unit 5 is an intermediate transfer means for transferring toner images formed on the respective photosensitive drums 1 (1*a*, 1*b*, 1*c*, 1*d*). The intermediate transfer unit 5 includes a driving roller 56, a driven roller 57, primary transfer rollers 58 (58*a*, 58*b*, 58*c*, 58*d*), and an opposing roller 59. The primary transfer rollers 58 are positioned to face the photosensitive drums 1 of different colors. The opposing roller 59 is positioned to face the secondary transfer roller 69. Further, a transfer belt (intermediate transfer belt) 9 is stretched around the rollers of the intermediate transfer unit 5.

The transfer belt 9 is circulated to face and touch all the photosensitive drums 1, and a voltage is applied to the primary transfer rollers 58 (58*a*, 58*b*, 58*c*, 58*d*) to conduct primary transfer from the photosensitive drums 1 onto the transfer belt 9. Then, a voltage is applied to the opposing roller 59, which is disposed inside the transfer belt 9, and the secondary transfer roller 69 to transfer the toner on the transfer belt 9 to the recording medium S.

In the image formation, each of the photosensitive drums 1 is rotated, and the scanner unit 3 selectively performs exposure on the photosensitive drums 1 charged uniformly by the charging rollers 2. In this way, an electrostatic latent image is formed on each of the photosensitive drums 1. The latent images are developed by the development rollers 25. In this way, toner images of the different colors are formed on the respective photosensitive drums 1. In synchronization with the image formation, the registration roller pair 55 conveys the recording medium S to a secondary transfer position at which the opposing roller 59 and the secondary transfer roller 69 are in contact with each other via the transfer belt 9.

Then, a transfer bias voltage is applied to the secondary transfer roller 69 to secondary transfer the toner images of the respective colors on the transfer belt 9 to the recording medium S. In this way, a color image is formed on the recording medium S. The recording medium S on which the color image is formed is heated and pressed by the fixing unit 74 to fix the toner images. Thereafter, the recording medium S is discharged to a discharge portion 75 by a discharging roller 72. The fixing unit 74 is disposed in an upper part of the image forming apparatus 100.

(Configuration of Process Cartridge)

Figure 3:
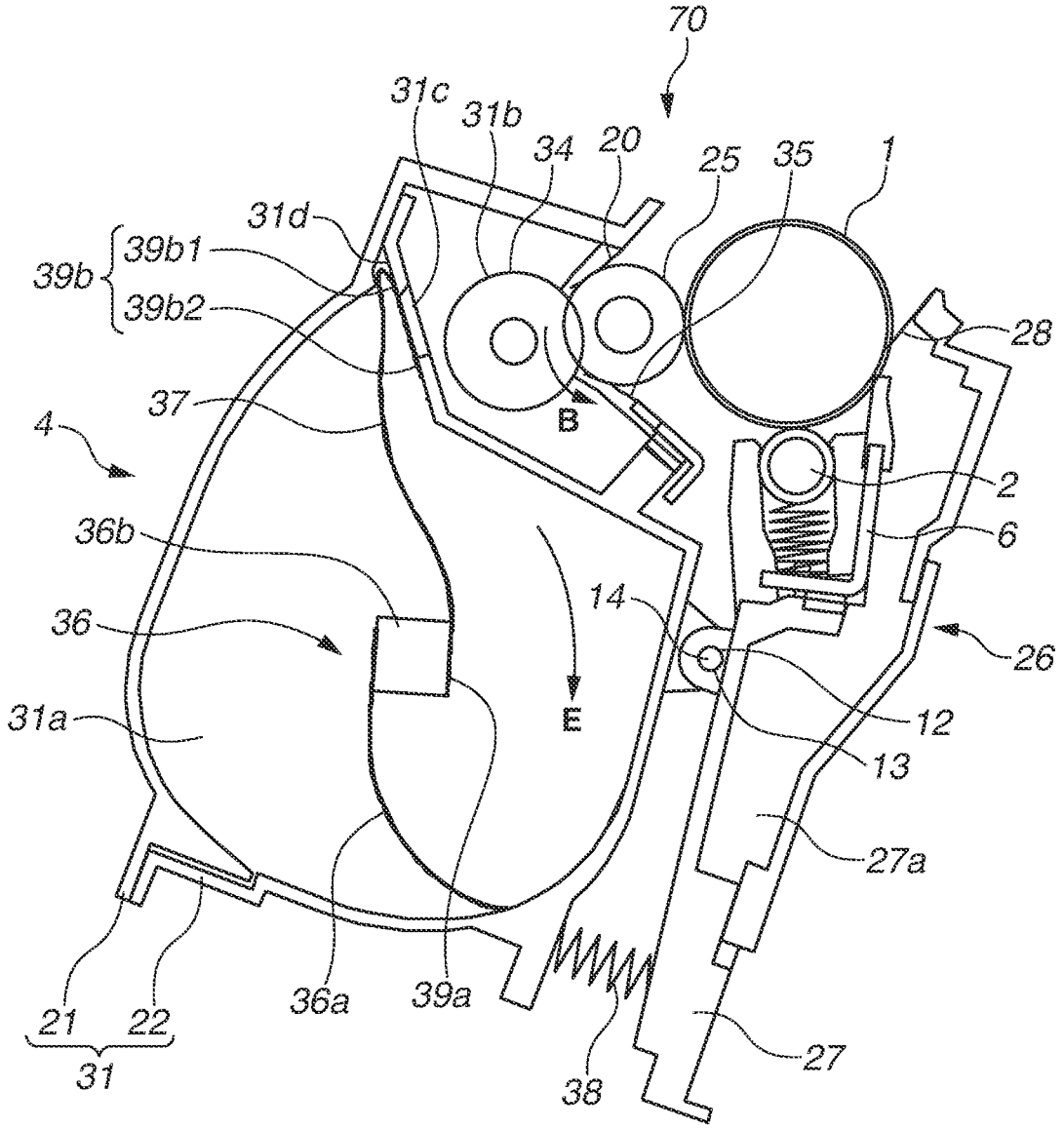
FIG. 3 is a main cross-sectional view illustrating a process cartridge according to the first exemplary embodiment.
Figure 4:
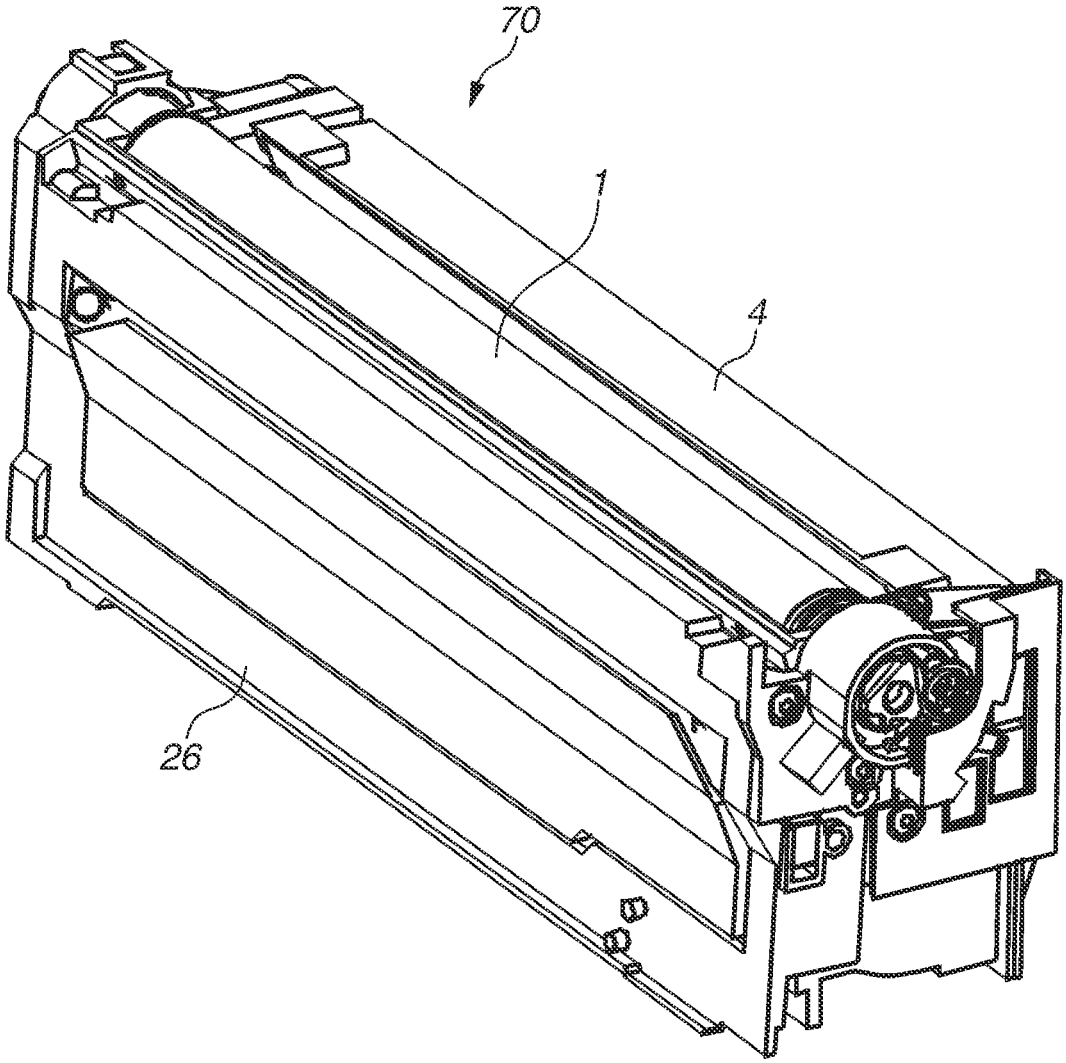
FIG. 4 is a perspective view illustrating an entire process cartridge according to the first exemplary embodiment.

The process cartridge according to the present exemplary embodiment will be described below. FIG. 3 is a main cross sectional view illustrating the process cartridge 70. FIG. 4 is a perspective view illustrating the entire process cartridge 70. In the present exemplary embodiment, the configuration in which the four process cartridges 70*a*, 70*b*, 70*c*, and 70*d* are included is described as an example. The process cartridge 70*a* is a process cartridge in which yellow (Y) developer 30 is stored. The process cartridge 70*b* is a process cartridge in which magenta (M) developer 30 is stored. The process cartridge 70*c* is a process cartridge in which cyan (C) developer 30 is stored. The process cartridge 70*d* is a process cartridge in which black (Bk) developer 30 is stored. The process cartridges 70*a*, 70*b*, 70*c*, and 70*d* have a similar configuration except that the colors of the developers stored therein are different, and accordingly the process cartridges 70*a*, 70*b*, 70*c*, and 70*d* will be described as the process cartridge 70.

As illustrated in FIG. 3, the process cartridge 70 according to the present exemplary embodiment is divided into a drum unit 26 and a developing apparatus 4.

The drum unit 26 includes a charging roller 2, a flexible sheet member 28, and a cleaning member 6 on the circumference of the photosensitive drum 1 serving as an image carrying member. The charging roller 2 is a primary charging means configured to uniformly charge the surface of the photosensitive drum 1. The flexible sheet member 28 is a member configured to prevent a residual developer remaining after the transfer from leaking through a space between the photosensitive drum 1 and a cleaning frame 27, i.e., leakage of waste developer. The cleaning member 6 is a cleaning means configured to remove waste developer remaining on the surface of the photosensitive drum 1. The waste developer removed from the surface of the photosensitive drum 1 by the cleaning member 6 is stored in a waste developer chamber 27*a* provided to the cleaning frame 27.

Figure 5:
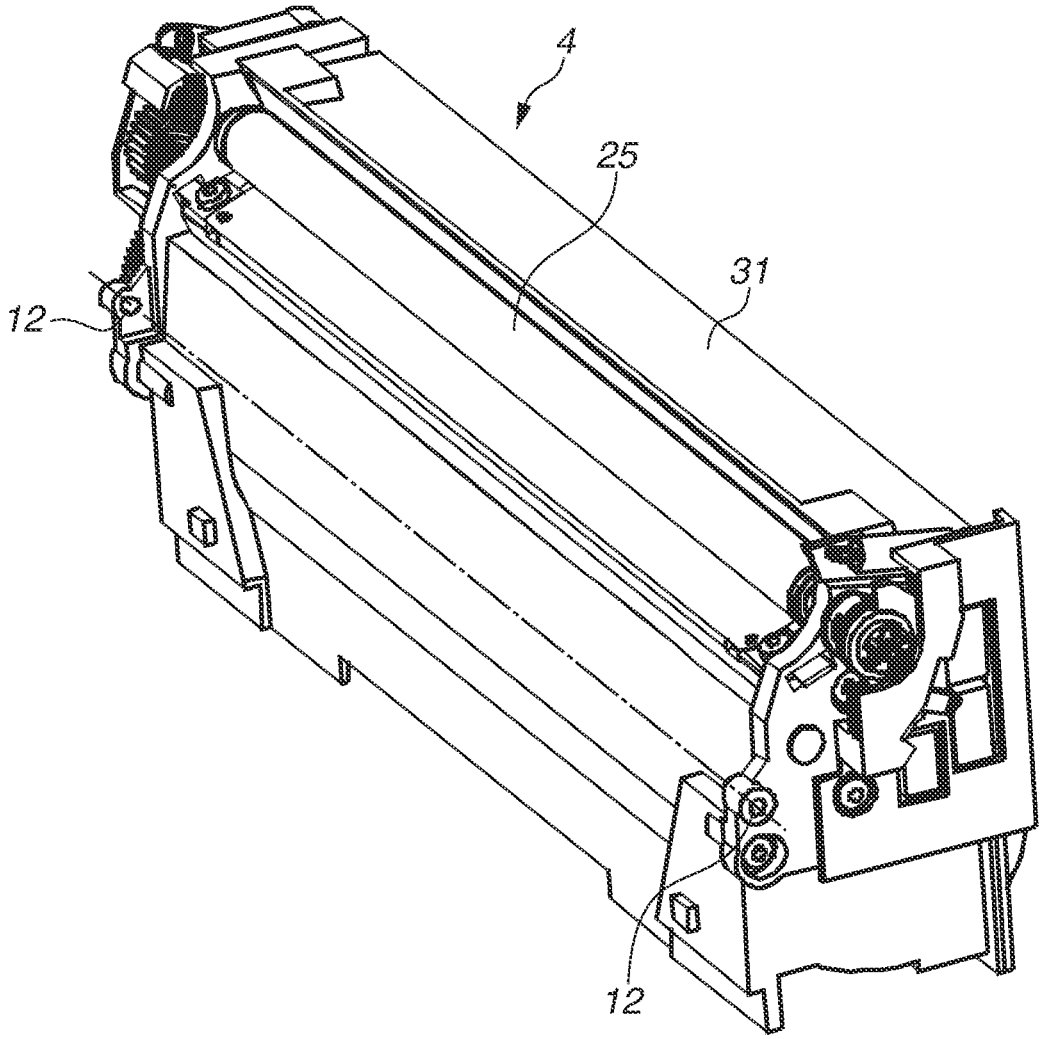
FIG. 5 is a perspective view illustrating an entire developing apparatus according to the first exemplary embodiment.

FIG. 5 is a perspective view of the entire developing apparatus 4 in the process cartridge 70. As to the container support configuration of the developing apparatus 4, the developing apparatus 4 is supported so as to be freely rotatable with respect to the drum unit 26. More specifically, connection holes 12 formed at both ends of the developing apparatus 4 and support holes 13 (FIG. 3) formed at both ends of the cleaning frame 27 of the drum unit 26 are aligned to overlapped each other, and pins 14 are inserted therein from both ends of the drum unit 26. Further, the developing apparatus 4 is constantly biased by a pressurizing spring 38 to pivot about the support holes 13 so that the development roller 25 contacts the photosensitive drum 1.

The developing apparatus 4 includes a development frame 31 including frames 21 and 22, the development roller 25, and a conveying unit 36. The development roller 25 is brought into contact with the photosensitive drum 1 and rotates in the direction of an arrow B. The conveying unit 36 conveys the developer 30 stored in a developer storage chamber 31*a* to a developer supply chamber 31*b*. The conveying unit 36 includes a conveying sheet 36*a* serving as a conveying portion, and an unsealing shaft 36*b*. The unsealing shaft 36*b* is a rotatably provided unsealing member. The unsealing shaft 36*b* is rotated in the direction indicated by an arrow E in FIG. 3, so that the developer 30 stored in the developer storage chamber 31*a* is conveyed to the developer supply chamber 31*b* through an opening 31*c* by the conveying sheet 36*a*. The development frame 31 includes the developer storage chamber 31*a* and the developer supply chamber (developing chamber) 31*b*. The developer storage chamber 31*a* includes the conveying unit 36 and is configured to store the developer 30. The developer supply chamber 31*b* is disposed above the developer storage chamber 31*a*, and includes the development roller 25. The developer storage chamber 31*a* and the developer supply chamber 31*b* are partitioned with a wall 31*d*. The wall 31*d* includes the opening 31*c* through which the developer storage chamber 31*a* and the developer supply chamber 31*b* are communicated with each other.

On the circumference of the development roller 25, a supply roller 34 and a development blade 35 are disposed. The supply roller 34 rotates while contacting the development roller 25. The development blade 35 is configured to reduce the thickness of a layer of the developer 30. Further, a blowout prevention sheet 20 serving as a development contact sheet is provided to prevent leakage of the developer 30 from the development frame 31 being in contact with the development roller 25.

Along with the rotation of the development roller 25, the developer 30 applied onto the development roller 25 is conveyed to a development portion where the photosensitive drum 1 and the development roller 25 face each other. In the development portion, the developer 30 on the development roller 25 adheres to an electrostatic latent image formed on the surface of the photosensitive drum 1 with a development bias applied from a power source (not illustrated). In this way, the electrostatic latent image is developed and visualized. Meanwhile, the developer 30 that has not contributed to the development of the electrostatic latent image and remains on the surface of the development roller 25 is returned into the developer supply chamber 31*b* and collected along with the rotation of the development roller 25.

The developing apparatus 4 is supported rotatably with respect to the drum unit 26. More specifically, the connection holes 12 formed in the development frame 31 at the both ends in the axial direction of the development roller 25 are overlapped with the support holes 13 formed in the cleaning frame 27 at the both ends in the axial direction of the photosensitive drum 1. Then, the pins 14 are inserted therein from the both ends of the drum unit 26. This configuration allows the developing apparatus 4 to pivot about the support holes 13 (pins 14) with respect to the drum unit 26. Further, as illustrated in FIG. 3, the developing apparatus 4 is biased by the pressurizing spring 38, and the biasing force brings the development roller 25 into contact with the photosensitive drum 1.

The conveying unit 36 includes the unsealing shaft 36*b* and the conveying sheet 36*a*, which is a conveying portion attached to the unsealing shaft 36*b* and is in the shape of a sheet. The unsealing shaft 36*b* is rotated so that the conveying sheet 36*a* is rotated in the direction of the arrow E to convey the developer 30 stored in the developer storage chamber 31*a* to the developer supply chamber 31*b*. In one end of the unsealing shaft 36*b* in the longitudinal direction (axial direction), a driving connection portion 36*c* configured to be connected to a driving unit (not illustrated) is provided. The driving unit and the driving connection portion 36*c* are connected so that the driving force from the driving unit is transmitted to the driving connection portion 36*c*, so that the unsealing shaft 36*b* is rotated.

Further, in the present exemplary embodiment, a seal member 37 serving as a seal member for sealing the opening 31*c* is attached to the unsealing shaft 36*b*. With movement (rotation) of the unsealing shaft 36*b*, the seal member 37 is removed from the wall 31*d*, and the opening 31*c* is exposed (unsealed). As illustrated in FIG. 3, the unsealing shaft 36*b* includes a fixed portion 39*a* to which the seal member 37 is bonded or welded. The seal member 37 is bonded or welded to the fixed portion 39*a* of the unsealing shaft 36*b*. Accordingly, the seal member 37 is fixed to the unsealing shaft 36*b* more firmly, compared with the configuration in which a seal member is fixed by being hooked in a hole. Further, a seal portion 39*b* is a portion, of the seal member 37, which is attached to the wall 31*d* of the development frame 31 around the opening 31*c*. The seal member 37 is attached to the wall 31*d* so as to surround the opening 31*c* with the seal portion 39*b*. More specifically, the seal member 37 is attached to the wall 31*d* over the opening 31*c* so that a first seal portion 39*b*1 of the seal member 37 is attached to an upper part of the wall 31*d* of the opening 31*c* while a second seal portion 39*b*2 of the seal member 37 is attached to a lower part of the wall 31*d* of the opening 31*c*. In this way, the seal member 37 is folded back on the upper side of the opening 31*c* (farther side from the unsealing shaft 36*b*) and extends over the opening 31*c* to the lower side of the opening 31*c* around the opening 31*c*, so that the seal member 37 is attached to the wall 31*d* so as to block the opening 31*c*.

The unsealing shaft 36*b* is rotated in the direction indicated by the arrow E in FIG. 3, removes the seal member 37 from the wall 31*d*, and winds the seal member 37 around the unsealing shaft 36*b* at the start of the use of the developing apparatus 4. The removal of the seal member 37 unseals the opening 31*c* so that the developer 30 can be supplied from the developer storage chamber 31*a* to the developer supply chamber 31*b* through the opening 31*c*.

<Positional Relationship Between Seal Portion and Fixed Portion and Relationship of Load Applied in Unsealing>

Figure 1:
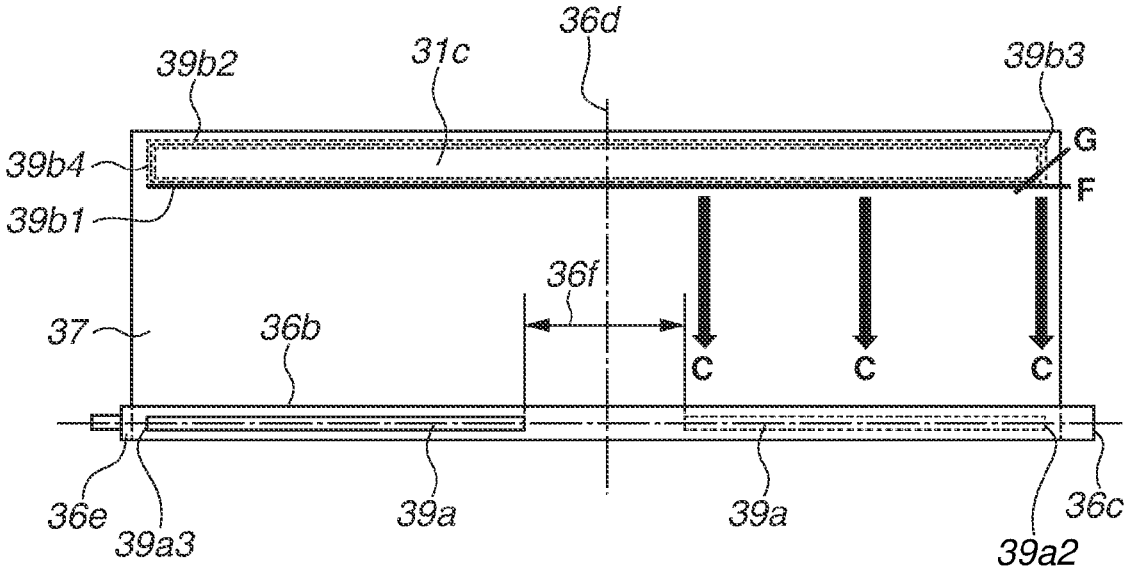
FIG. 1 is a plan view illustrating a positional relationship between a seal portion of a seal member and a fixed portion fixed to an unsealing shaft according to a first exemplary embodiment.
Figure 6:
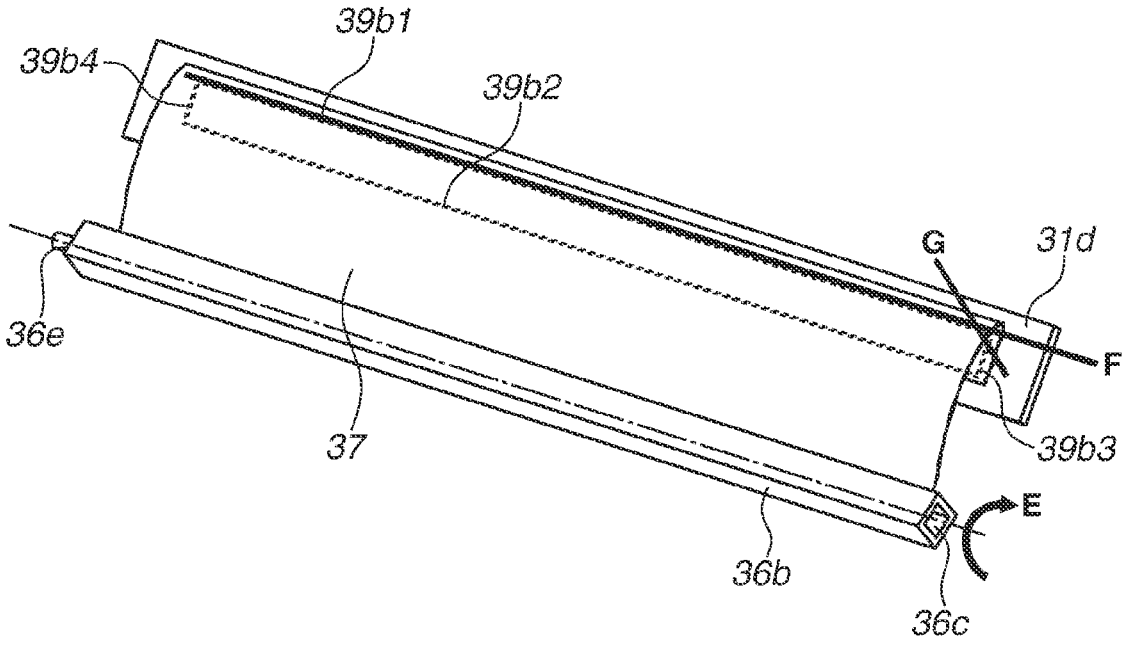
FIG. 6 is a perspective view illustrating a state in which the seal portion side of a seal member fixed to the unsealing shaft is folded back and fixed to a development frame.

FIG. 6 is a perspective view illustrating a state in which the seal portion 39*b* of the seal member 37 attached to the unsealing shaft 36*b* is folded back and fixed to the wall 31*d* of the developer storage chamber 31*a*. FIG. 1 is a plan view illustrating the positional relationship between the seal portion 39*b* of the seal member 37 and the fixed portion 39*a* of the unsealing shaft 36*b*. In FIG. 1, the folded portion of the seal member 37 is expanded and projected onto a planar surface. The driving force from the driving unit (not illustrated) is transmitted to the driving connection portion 36*c* of the unsealing shaft 36*b* to rotate the unsealing shaft 36*b* in the direction indicated by the arrow E specified in FIG. 3. As a result, at the time of the rotation of the unsealing shaft 36*b*, the load applied to the unsealing shaft 36*b* is transmitted from the driving connection portion 36*c* which is one end side of the unsealing shaft 36*b* in the longitudinal direction, to the other end side (hereinafter, referred to as "other end side 36*e*) in the longitudinal direction. The fixed portions 39*a* of the seal member 37 are located in the both sides of the unsealing shaft 36*b* excluding in a portion around a center 36*d* in the longitudinal direction (axial direction). As illustrated in FIG. 1, there is a central portion 36*f* including the longitudinal center 36*d* of the unsealing shaft 36*b* in the longitudinal direction (axial direction), and the fixed portion 39*a* does not exist in the central portion 36*f*. The length of the central portion 36*f* including the center 36*d* in the longitudinal direction is desirably in the range of one third to one sixth of the length of the seal member 37 in the longitudinal direction when the length of the seal member 37 in the longitudinal direction is 1. The central portion 36*f* is desirably symmetrical about the center 36*d*. A removal force C (refer to FIG. 1) that removes the seal member 37 from the wall 31*d* is transmitted from the unsealing shaft 36*b* to the seal member 37 through the fixed portion 39*a*, and removes the seal portion 39*b* of the seal member 37 from the wall 31*d*. The seal member 37 is not fixed at the center 36*d* of the unsealing shaft 36*b*, so that the force that removes the longitudinal center 36*d* of the seal portion 39*b* is transmitted from an outer endmost portion 39*a*1 of the fixed portion 39*a* in the longitudinal direction to the longitudinal center 36*d*. Accordingly, a path through which the force is transmitted to the seal portion 39*b* via the seal member 37 is longer at the center 36*d* in the longitudinal direction than at the both ends of the unsealing shaft 36*b* in the longitudinal direction. As a result, the time of the transmission of the removal force from the unsealing shaft 36*b* to the seal portion 39*b* is longer at the center 36*d* of the seal portion 39*b* in the longitudinal direction than at the both ends. Therefore, when the removal force is applied to the seal member 37, the removal of the end portions of the seal portion 39*b* starts before the removal of the center 36*d* in the longitudinal direction.

Figure 7:
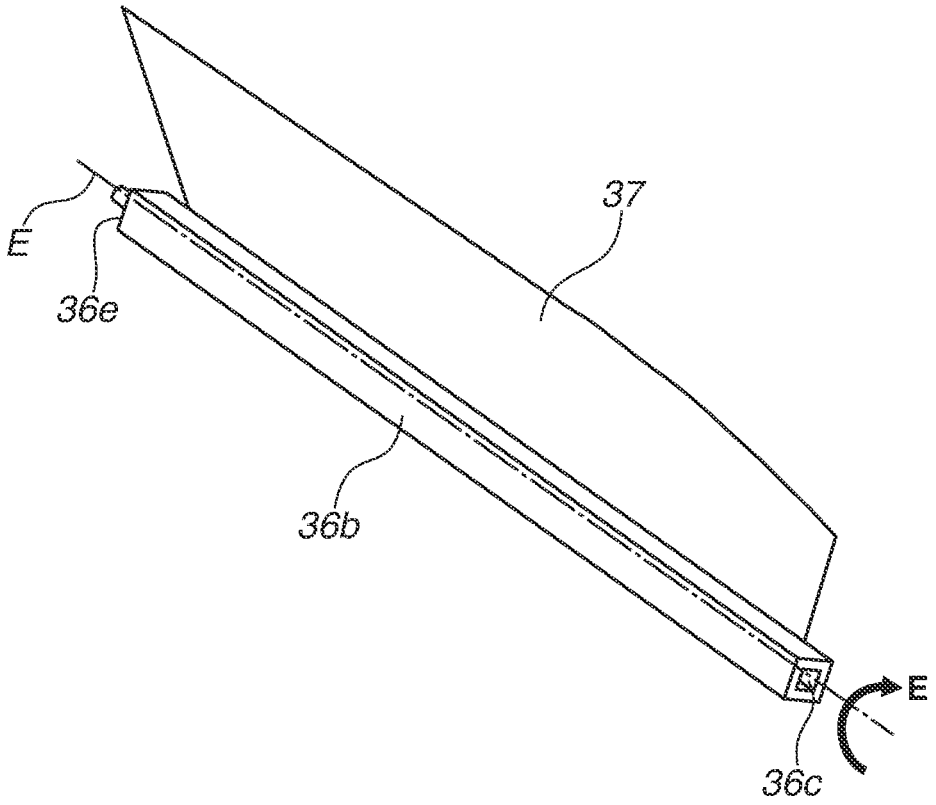
FIG. 7 illustrates a state in which the unsealing shaft is twisted.

Further, the driving force that rotates the unsealing shaft 36*b* is applied to the driving connection portion 36*c*, which is one end side of the unsealing shaft 36*b* in the longitudinal direction, so that the driving force applied to the unsealing shaft 36*b* is larger at the driving connection portion 36*c* than at the other end side 36*e* in the longitudinal direction. Accordingly, as illustrated in FIG. 7, at the time of unsealing the seal member 37, the driving connection portion 36*c* side of the unsealing shaft 36*b* is twisted farther toward a downstream side in the rotation direction E than the other end side 36*e*. The driving connection portion 36*c* side of the unsealing shaft 36*b* is twisted farther toward a downstream side in the rotation direction E than the other end side 36*e* so that the removal of a seal portion driving end side 39*b*3 of the seal member 37 starts before the removal of a seal portion other end side 39*b*4. As used herein, the seal portion driving end side 39*b*3 of the seal member 37 refers to a side that corresponds to the driving connection portion 36*c* side of the unsealing shaft 36*b*, and the seal portion other end side 39*b*4 refers to a side that corresponds to the other end side 36*e* of the unsealing shaft 36*b* in the longitudinal direction (refer to FIG. 10).

At the time of removing the seal member 37, if the seal portion driving end side 39*b*3 cannot be removed first, the first seal portion 39*b*1 on a longitudinal line F specified in FIGS. 1 and 6 is to be removed simultaneously along the longitudinal direction. This increases an area of the seal portion 39*b* to be removed so as to remove the seal member 37 and also increases the load applied to the unsealing shaft 36*b*. If the removal is started at the seal portion driving end side 39*b*3, the end portion of the seal portion 39*b* in the longitudinal direction is removed first. More specifically, the removal is started at the seal portion 39*b* fixed on an oblique line G, which intersects with the longitudinal direction as specified in FIGS. 1 and 6. As a result, the area of the seal portion 39*b* that is to be removed simultaneously can be reduced. Accordingly, use of the configuration according to the present exemplary embodiment can decrease the area of the seal portion 39*b* that is to be removed simultaneously at the time of unsealing the seal member 37, so that the load applied at the time of unsealing the seal member 37 can be decreased.

Figure 8A:
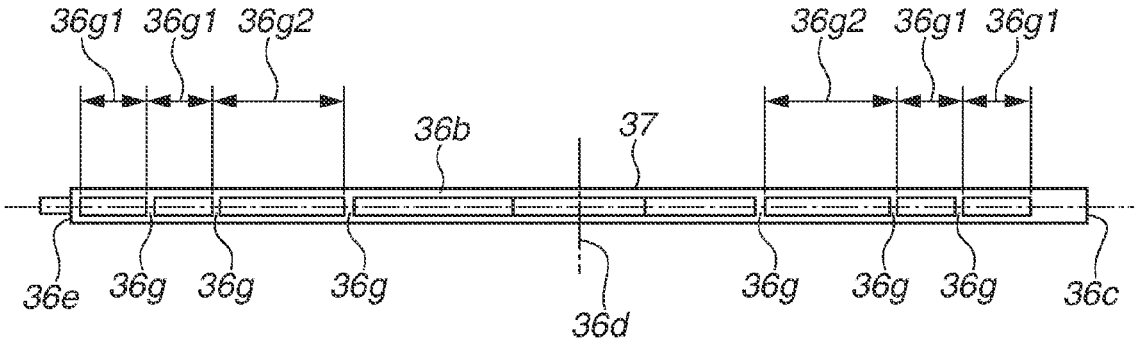
FIG. 8A is a top view illustrating a positional relationship between reinforcing portions of the unsealing shaft.
Figure 8B:
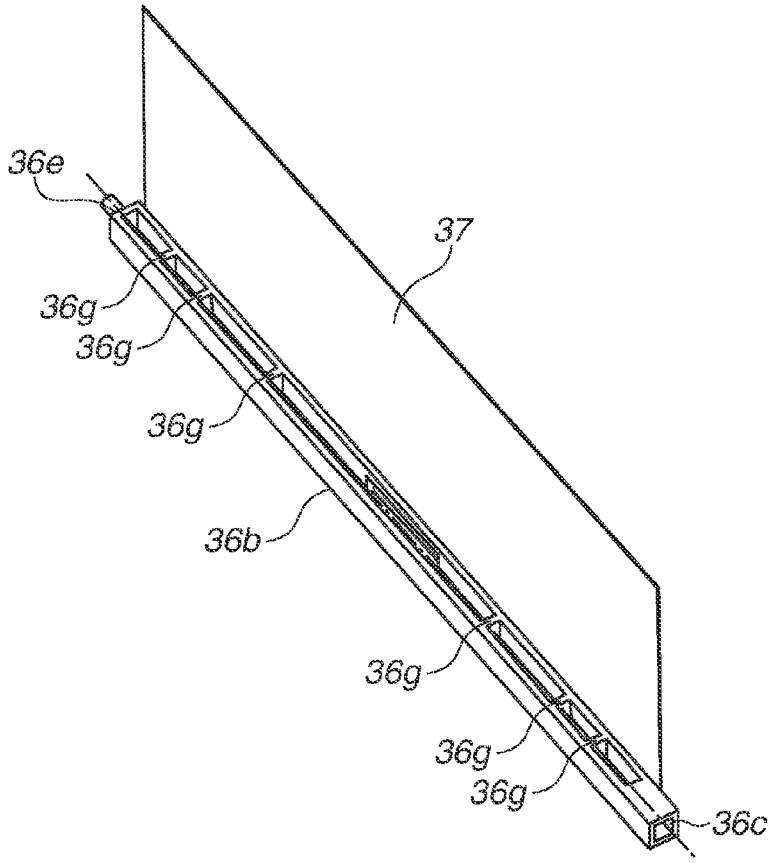
FIG. 8B is a perspective view thereof.

As illustrated in FIGS. 8A and 8B, the unsealing shaft 36*b* has a hollow shape and includes a plurality of reinforcing portions 36*g* provided to the hollow shape. The reinforcing portions 36*g* are disposed with a distance therebetween in the longitudinal direction of the unsealing shaft 36*b*. The distance between the reinforcing portions 36*g* in the longitudinal direction is set such that a distance 36*g*2 which is closer to the center 36*d* of the unsealing shaft 36*b* in the longitudinal direction is larger than a distance 36*g*1 closer to the respective longitudinal ends of the unsealing shaft 36*b*. When the distance 36*g*2 closer to the longitudinal center 36*d* is larger than the distance 36*g*1 closer to the respective end portions, the strength is lower at the longitudinal center 36*d* of the unsealing shaft 36*b* than at the respective end portions. Accordingly, when the load is applied to the unsealing shaft 36*b* at the time of unsealing the seal member 37, the center 36*d* of the unsealing shaft 36*b* in the longitudinal direction is easily twisted. As described above, the unsealing shaft 36*b* is twisted, so that the removal is started at the end portion of the seal portion 39*b* in the longitudinal direction. As a result, the load applied at the time of unsealing the seal member 37 can be decreased.

Desirably, the shape of the fixed portion 39*a* of the unsealing shaft 36*b* is a rectangular shape. The force applied to the unsealing shaft 36*b* at the time of unsealing the seal member 37 is transmitted from the fixed portion 39*a* of the unsealing shaft 36*b* to the seal member 37. In order to ensure that the force from the fixed portion 39*a* is transmitted to the seal member 37, the fixed portion 39*a* is configured to have a rectangular shape to increase the area to be fixed, so that the strength of the fixing of the seal member 37 to the unsealing shaft 36*b* increases. If the strength of the fixing is low, the fixed portion 39*a* may be removed from the unsealing shaft 36*b* at the time of unsealing the seal member 37, and the force may not be transmitted to the seal member 37. Accordingly, the rectangular shape that can increase the strength of the fixing is desirable. As to a method of fixing the fixed portion 39*a* to the unsealing shaft 36*b*, a heat sealing method such as thermal welding is used, but a fixing method using ultrasonic welding or using an adhesive member such as a bonding agent and a two-sided tape can be also used.

Desirably, the unsealing shaft 36*b* has elasticity. With the unsealing shaft 36*b* having elasticity, when the driving force is transmitted, load is applied to the unsealing shaft 36*b*, the unsealing shaft 36*b* is easily twisted with respect to a material having rigidity. Therefore, as described above, the load at the time of unsealing the seal member 37 can be decreased.

Desirably, the fixed portion 39*a* is located at a predetermined distance or longer from the center 36*d*, in the longitudinal direction, in the axial direction of the unsealing shaft 36*b*. The fixed portion 39*a* is located at a predetermined distance or longer from the center 36*d* in the longitudinal direction, so that the load transmitted from the fixed portion 39*a* to the unsealing shaft 36*b* is transmitted to the end portions. With the load applied to the end portions, the unsealing shaft 36*b* can be twisted easily. In the present exemplary embodiment, 15 mm is specified as an example of the predetermined distance.

Figure 9:
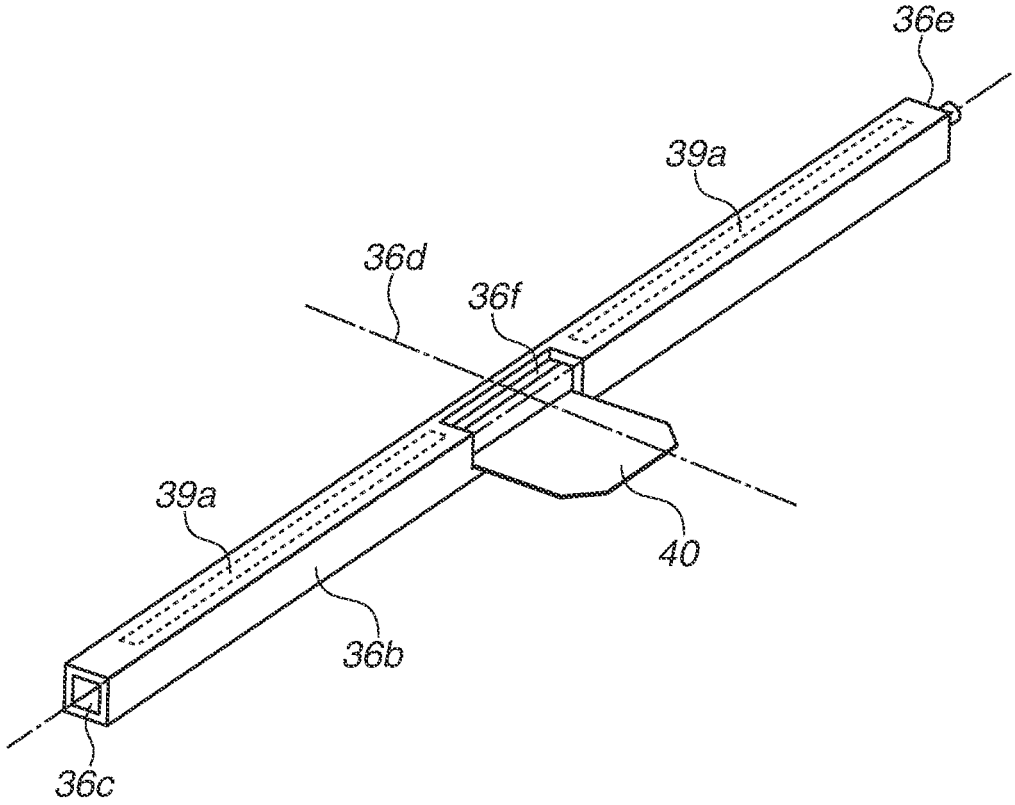
FIG. 9 is a perspective view illustrating a state in which the unsealing shaft is provided with a cleaning member.

Further, as illustrated in FIG. 9, the fixed portion 39*a* is located on the respective sides excluding on the center 36*d* in the longitudinal direction, so that an attachment surface for the fixed portion 39*a* is not required at the center 36*d* in the longitudinal direction. Accordingly, in a case where a residual amount detection unit (not illustrated) configured to detect the amount of residual developer is provided near the center 36*d* of the development frame 31 in the longitudinal direction, a cleaning member 40 for removing the developer 30 adhering to the residual amount detection unit may be provided to the longitudinal central portion 36*f*. While the configuration in which the cleaning member 40 is provided to the central portion 36*f* of the unsealing shaft 36*b* is described as an example in the present exemplary embodiment, the present invention is not limited thereto. Alternatively, another member may be provided. The length of the central portion 36*f* can be changed according to the length at the time of fixing another member to the central portion 36*f* of the unsealing shaft 36*b*.

Figure 10:
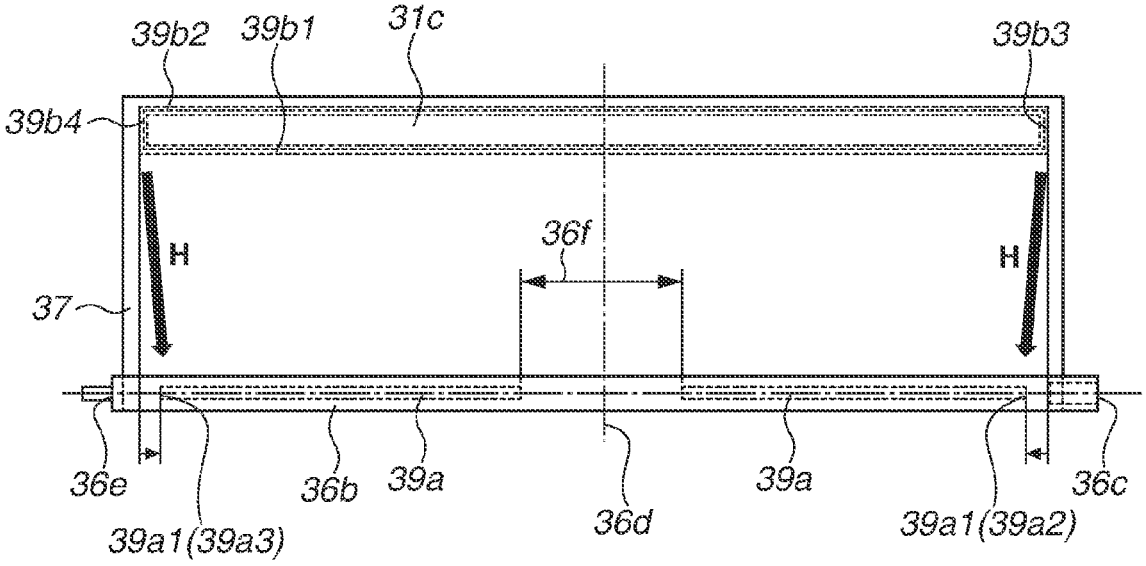
FIG. 10 is a plan view illustrating a positional relationship between an endmost portion of the fixed portion and an endmost portion of the seal portion.

Further, FIG. 10 is a plan view illustrating the positional relationship between the fixed portion 39*a* and the seal portion 39*b* in the axial direction of the unsealing shaft 36*b*. In FIG. 10, the folded portion of the seal member 37 is expanded and projected onto a planar surface. In the axial direction (longitudinal direction) of the unsealing shaft 36*b*, an endmost portion of the fixed portion 39*a* on the driving connection portion 36*c* side, which is one outer side in the longitudinal direction, is referred to as a fixed portion driving end side 39*a*2, and an endmost portion of the fixed portion 39*a* on the other end side 36*e*, which is the other outer side, is referred to as a fixed portion other end side 39*a*3. In the axial direction of the unsealing shaft 36*b*, the fixed portion driving end side 39*a*2 is located inside the seal portion driving end side 39*b*3 of the seal portion 39*b*, and the fixed portion other end side 39*a*3 is located inside the seal portion other end side 39*b*4 of the seal portion 39*b*.

Figure 11:
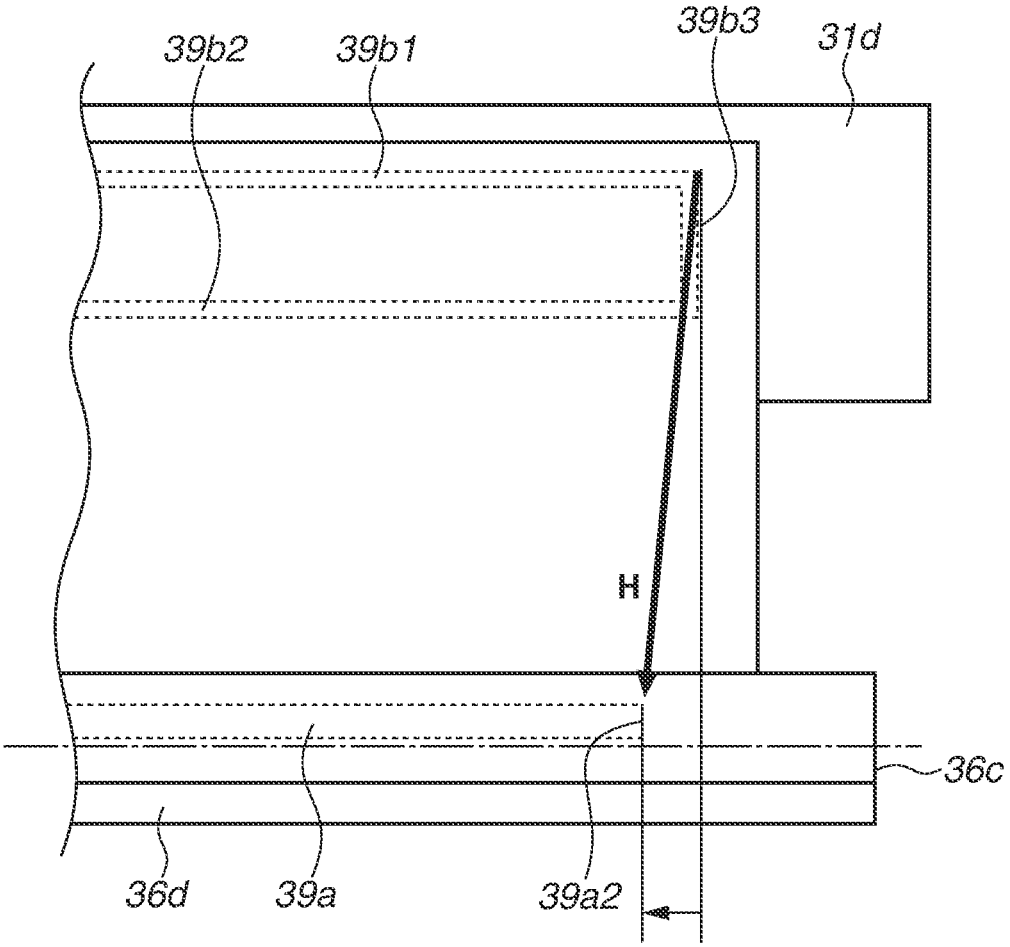
FIG. 11 is a main part enlarged view illustrating a positional relationship between the endmost portion of the fixed portion and the endmost portion of a seal portion.

The endmost portion of the fixed portion 39*a* is located inside the endmost portion of the seal portion 39*b*, so that the removal direction at the time of unsealing the seal member 37 is a direction connecting the seal portion driving end side 39*b*3 to the fixed portion driving end side 39*a*2 and a direction connecting the seal portion other end side 39*b*4 to the fixed portion other end side 39*a*3. More specifically, the seal portion 39*b* is removed in the direction of an arrow H specified in FIG. 10. FIG. 11 is an enlarged view of the vicinity of the seal portion driving end side 39*b*3 viewed from the normal line direction with respect to the planar surface of the wall 31*d*, illustrating the state in which the seal member 37 is folded and fixed to the wall 31*d*. The direction of the arrow H, which is the removal direction at the time of the unsealing, is not an orthogonal direction with respect to the first seal portion 39*b*1. In the case of an orthogonal direction, the entire first seal portion 39*b*1 needs to be removed simultaneously along the longitudinal direction, so that the area to be removed simultaneously increases. If the removal direction is shifted to an intersecting direction (direction of the arrow H) that is not an orthogonal direction, a corner portion of the seal portion 39*b* is removed, so that the area of the seal portion 39*b* that is to be removed simultaneously decreases. Consequently, the load at the time of the unsealing can be decreased. While the seal portion driving end side 39*b*3 is described above, the load in unsealing the seal member 37 can be also decreased in the case of the seal portion other end side 39*b*4 by shifting the removal direction from an orthogonal direction.

As illustrated in FIGS. 10 and 11, as to an allowable range in which the endmost portion of the fixed portion 39*a* is located inside the endmost portion of the seal portion 39*b*, the unsealing shaft 36*b* is supported by the developer storage chamber 31*a* with a space in the longitudinal direction, and the difference between the endmost portions is desirably larger than the space. Since the difference between the endmost portions is larger than the space, even if the unsealing shaft 36*b* is moved by the space within the developer storage chamber 31*a*, it is ensured that the endmost portion of the fixed portion 39*a* is located inside the endmost portion of the seal portion 39*b*. Accordingly, the advantageous effect described above can be produced by setting the positional relationship between the fixed portion and the seal portion in the longitudinal direction within the allowable range.

Figure 12:
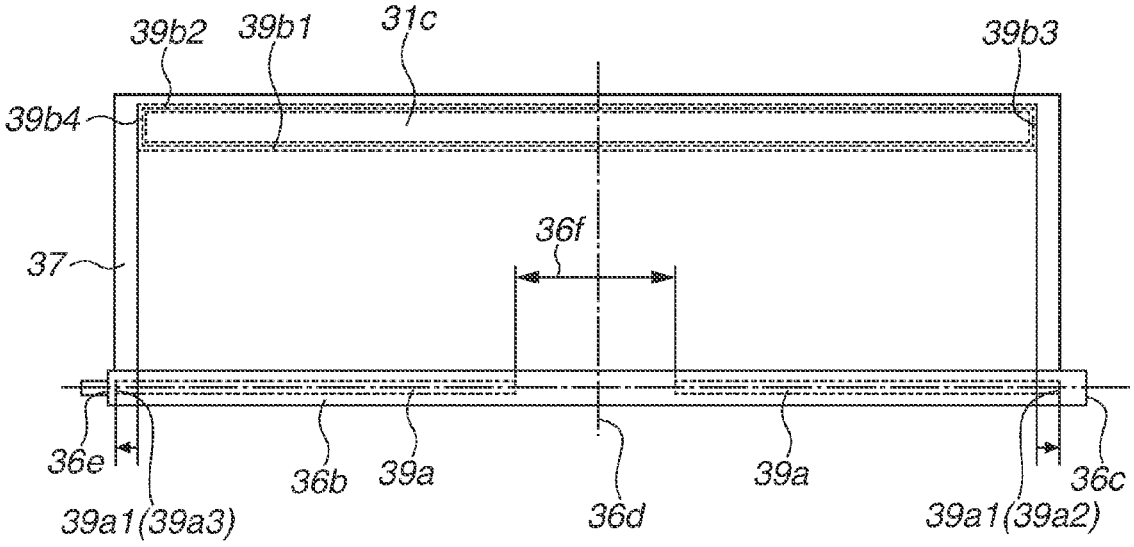
FIG. 12 is a plan view illustrating the positional relationship between the endmost portion of the fixed portion and the endmost portion of a seal portion.

Further, the positional relationship between the fixed portion 39*a* and the seal portion 39*b* in the axial direction of the unsealing shaft 36*b* is not limited to those illustrated in FIGS. 10 and 11. FIG. 12 is a plan view illustrating the positional relationship between the fixed portion 39*a* and the seal portion 39*b* in the axial direction of the unsealing shaft 36*b*. In FIG. 12, the folded portion of the seal member 37 is expanded and projected onto a planar surface. In the axial direction (longitudinal direction) of the unsealing shaft 36*b*, an endmost portion of the fixed portion 39*a* on the driving connection portion 36*c* side, which is one outer side in the longitudinal direction, is referred to as a fixed portion driving end side 39*a*2, and an endmost portion of the fixed portion 39*a* on the other end side 36*e*, which is the other outer side, is referred to as a fixed portion other end side 39*a*3. In the axial direction of the unsealing shaft 36*b*, the fixed portion driving end side 39*a*2 may be located outside the seal portion driving end side 39*b*3 of the seal portion 39*b*, and the fixed portion other end side 39*a*3 may be located outside the seal portion other end side 39*b*4 of the seal portion 39*b*.

With the endmost portion of the fixed portion 39*a* being located outside the endmost portion of the seal portion 39*b*, removal of the seal member 37 from the wall 31*d* around the opening 31*c* due to shaking or impact applied during the transportation of the developing apparatus 4 can be prevented while fixing strength is reduced.

As illustrated in FIG. 12, as to an allowable range in which the endmost portion of the fixed portion 39*a* is located outside the endmost portion of the seal portion 39*b*, the unsealing shaft 36*b* is supported by the developer storage chamber 31*a* with a space in the longitudinal direction and the difference between the endmost portions is desirably larger than the space. The difference between the endmost portions is larger than the space, so that even if the unsealing shaft 36*b* is moved by the space within the developer storage chamber 31*a*, it is ensured that the endmost portion of the fixed portion 39*a* is located outside the endmost portion of the seal portion 39*b*. Accordingly, the advantageous effect described above can be produced by setting the positional relationship between the fixed portion 39*a* and the seal portion 39*b* in the longitudinal direction within the allowable range.

According to the present exemplary embodiment, at the time of removing the seal member 37 with the unsealing shaft 36*b*, the load is applied to the unsealing shaft 36*b* through the fixed portion 39*a* provided to the both sides of the unsealing shaft 36*b* excluding a portion around the center thereof in the longitudinal direction. Accordingly, the load is applied to the both end sides of the unsealing shaft 36*b*, and the load is applied in the direction that the end portion of the unsealing shaft 36*b* is twisted. Further, since the driving force is transmitted from the driving connection portion 36*c* of the unsealing shaft 36*b*, the load at the time of the rotation of the unsealing shaft 36*b* is transmitted from the driving end side to the other end side in the longitudinal direction. Accordingly, with the load applied to the driving end side, which is one end side of the unsealing shaft 36*b* in the longitudinal direction, the driving end side of the unsealing shaft 36*b* is more twisted. With the driving end side of the unsealing shaft 36*b* twisted first, at the time of removing the seal member 37, the removal of the seal member 37 is started at the end portion of the seal portion 39*b* provided to the driving end side of the unsealing shaft 36*b*. As a result, the area of the seal member 37 that is to be removed simultaneously decreases, so that the load applied at the time of removing the seal member 37 to start the use of the developing apparatus can be decreased.

OTHER EXEMPLARY EMBODIMENT

Figure 13:
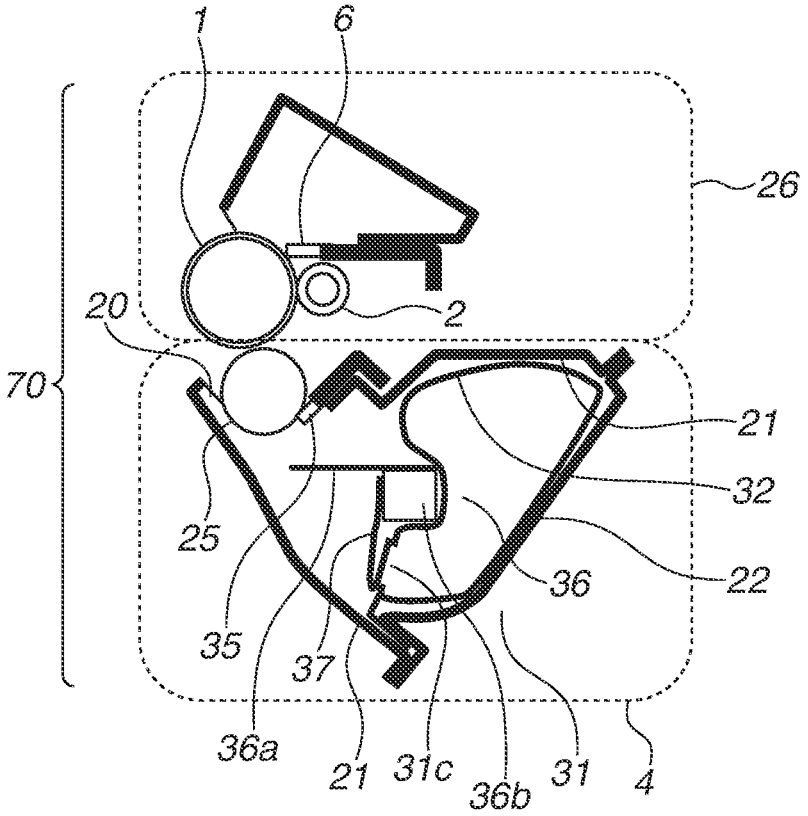
FIG. 13 is a main cross-sectional view illustrating a process cartridge according to another exemplary embodiment.

While, in the foregoing exemplary embodiments, the configuration in which developer is stored in a frame (the developer storage chamber 31*a* of the development frame 31) is described as an example, the present invention is not limited thereto. An exemplary embodiments of the present invention is also applicable to a configuration including a development frame 31 and a flexible container 32 configured to store developer as illustrated in FIG. 13. FIG. 13 is a schematic cross-sectional view illustrating a process cartridge to which the foregoing configuration is applied.

In the process cartridge illustrated in FIG. 13, a flexible container 32 storing developer is included within a development frame 31 of a developing apparatus 4, and a part of the flexible container 32 is fixed to the development frame 31. An opening 31*c* of the flexible container 32 is sealed with a seal member fixed to an unsealing shaft 36*b* of a conveying unit 36. The seal member 37 is removed from the flexible container 32 with rotation of the unsealing shaft 36*b*, so that the opening 31*c* is unsealed, and then the developer is supplied. The rest of the configuration is similar to that of the foregoing exemplary embodiment, so the same reference numerals are given to members having similar functions to those of the members described in the foregoing exemplary embodiment to incorporate the description, and description of the members is omitted.

The configuration including the flexible container storing the developer can produce an advantage similar to that produced by the foregoing exemplary embodiments by application of the present exemplary embodiment.

Further, while the process cartridge 70 including the photosensitive drum 1 and the developing apparatus 4 that are integrated is described in the foregoing exemplary embodiments, the present invention is not limited thereto. For example, a developer container in which a development frame 31 storing developer and a conveying unit 36 are integrally included may be employed. Further, a developing apparatus in which the developer container and a development roller 25 are integrally included may be employed. Application of the present exemplary embodiment to the developer container or the developing apparatus as well as the process cartridge described above can produce an advantage similar to that produced by the foregoing exemplary embodiment.

Further, while four process cartridges are used in the foregoing exemplary embodiment, the number of process cartridges to be used is not limited to four and may be set as appropriate and as needed.

Further, while the printer is described as an example of the image forming apparatus in the foregoing exemplary embodiments, the image forming apparatus is not limited thereto. For example, another image forming apparatus such as a copying machine and a facsimile apparatus or an image forming apparatus, including a combination of the foregoing functions, such as a multifunction peripheral may be employed. Further, while, in the foregoing exemplary embodiment, the image forming apparatus is provided with an intermediate transfer member in which toner images of different colors are sequentially superimposed and transferred onto the intermediate transfer member, and the toner images carried by the intermediate transfer member are collectively transferred to a recording medium, the present invention is not limited thereto. For example, an image forming apparatus, provided with a recording medium carrying member, in which toner images of different colors are sequentially superimposed and transferred to a recording medium carried by the recording medium carrying member may be employed. Application of the present exemplary embodiment to the developer container, the developing apparatus, or the process cartridge included in the image forming apparatuses can produce an advantage similar to that produced by the foregoing exemplary embodiment.

According to an exemplary embodiment of the present invention, removal of a seal member can be started at a longitudinal end portion by use of a simpler configuration to decrease the load applied at the time of removing the seal member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-065556, filed Mar. 27, 2015, and No. 2015-065557, filed Mar. 27, 2015, which are hereby incorporated by reference herein in their entirety.

What is claimed is:

1. A developer container comprising:

a frame, including an opening, configured to store developer;

a seal member configured to seal the opening; and an unsealing member including a fixing portion to which the seal member is bonded or welded, wherein the unsealing member includes the fixing portion on both sides in a longitudinal direction thereof excluding on a center portion in the longitudinal direction thereof, and wherein, by movement of the unsealing member, the seal member is removed from the frame to unseal the opening.

2. The developer container according to claim 1, wherein an end portion of the seal member is folded back on a side farther from the unsealing member with respect to the opening and extends to a side closer to the unsealing member to seal the opening.

3. The developer container according to claim 1, wherein the unsealing member includes a conveying portion configured to convey the stored developer.

4. The developer container according to claim 1, wherein the unsealing member has a hollow shape and includes a plurality of reinforcing portions provided to the hollow shape, and wherein each of the plurality of reinforcing portions is disposed with a distance therebetween in the longitudinal direction of the unsealing member, and the distance between each of the plurality of reinforcing portions is larger on a side closer to a center in the longitudinal direction of the unsealing member than on a side closer to each side in the longitudinal direction of the unsealing member.

5. The developer container according to claim 1, wherein a shape of the fixing portion of the unsealing member is a rectangular shape.

6. The developer container according to claim 1, wherein the unsealing member has elasticity.

7. The developer container according to claim 1, wherein the fixing portion is located at a predetermined distance or longer from a center in the longitudinal direction of the unsealing member.

8. The developer container according to claim 1, further comprising a seal portion configured to fix the seal member to the frame around the opening, wherein an outer endmost portion of the fixing portion in the longitudinal direction is located longitudinally outside an outer endmost portion of the seal portion in the longitudinal direction.

9. The developer container according to claim 1, further comprising a seal portion configured to fix the seal member to the frame around the opening, wherein an outer endmost portion of the fixing portion in the longitudinal direction is located longitudinally inside an outer endmost portion of the seal portion in the longitudinal direction.

10. The developer container according to claim 1, wherein the unsealing member is a rotatably-provided unsealing shaft and, by rotation of the unsealing member, the seal member is removed from the frame to open the opening.

11. A developing apparatus comprising:

a developer container according to claim 1; and a developer carrying member configured to carry developer.

12. The developing apparatus according to claim 11, wherein the developer carrying member is disposed above the unsealing member.

13. The developing apparatus according to claim 11, wherein the frame includes:

a storage chamber, including the unsealing member, configured to store developer; and a developing chamber, including the developer carrying member, disposed above the storage chamber via a wall including the opening.

14. A process cartridge comprising: a developer container according to claim 1.

15. An image forming apparatus, comprising: a developer container according to claim 1, configured to form an image on a recording medium with developer.

16. The developer container according to claim 1, wherein the unsealing member has a cleaning member for removing the developer adhering to a residual amount detection unit.

17. The developer container according to claim 1, wherein a cleaning member is provided to the central portion.

18. A developer container comprising:

a frame;

a flexible container, including an opening, configured to store developer;

a seal member configured to seal the opening; and an unsealing member including a fixing portion to which the seal member is bonded or welded, wherein the unsealing member includes the fixing portion on both sides in a longitudinal direction thereof excluding on a center portion in the longitudinal direction thereof, and wherein, by movement of the unsealing member, the seal member is removed from the flexible container to unseal the opening.

19. A developer container comprising:

a frame, including an opening, configured to store developer;

a seal member including a seal portion configured to be fixed to the frame around the opening; and an unsealing member including a fixing portion to which the seal member is welded, wherein, by movement of the unsealing member, the seal member is removed from the frame to unseal the opening, and wherein an outer endmost portion of the fixing portion in the longitudinal direction is located longitudinally outside an outer endmost portion of the seal portion in the longitudinal direction, wherein an inner end portion of the fixing portion in the longitudinal direction is located longitudinally inside an outer endmost portion of the seal portion in the longitudinal direction.

20. The developer container according to claim 19, wherein the unsealing member includes a conveying portion configured to convey the stored developer.

21. The developer container according to claim 19, wherein an end portion of the seal member is folded back on a side farther from the unsealing member with respect to the opening and extends to a side closer to the unsealing member to seal the opening.

22. The developer container according to claim 19, wherein the unsealing member is a rotatably-provided unsealing shaft, and, by rotation of the unsealing member, the seal member is removed from the frame to open the opening.

23. A developing apparatus comprising:

a developer container according to claim 19; and a developer carrying member configured to carry developer.

24. The developing apparatus according to claim 23, wherein the developer carrying member is disposed above the unsealing member.

25. The developing apparatus according to claim 23, wherein the frame includes: a storage chamber, including the unsealing member, configured to store developer; and a developing chamber, including the developer carrying member, disposed above the storage chamber via a wall including the opening.

26. A process cartridge comprising:

a developer container according to claim 19; and an image carrying member configured to carry a developer image.

27. An image forming apparatus, comprising a developer container according to claim 19, configured to form an image on a recording medium with developer.

28. The developer container according to claim 19, wherein the unsealing member has a cleaning member for removing the developer adhering to a residual amount detection unit.

29. The developer container according to claim 28, wherein the cleaning member is provided to a central portion of unsealing member.

30. A developer container comprising:

a frame;

a flexible container, including an opening, configured to store a developer;

a seal member including a seal portion configured to be fixed to the frame around the opening; and an unsealing member including a fixing portion to which the seal member is welded, wherein, by movement of the unsealing member, the seal member is removed from the flexible container to unseal the opening, and wherein an outer endmost portion of the fixing portion in the longitudinal direction is located longitudinally outside an outer endmost portion of the seal portion in the longitudinal direction, wherein an inner end portion of the fixing portion in the longitudinal direction is located longitudinally inside an outer endmost portion of the seal portion in the longitudinal direction.

31. A developer container comprising:

a frame, including an opening, configured to store developer;

a seal member configured to seal the opening; and an unsealing member, including first and second fixing portions to which the seal member is bonded or welded, for unsealing the opening by movement of the unsealing member, wherein a gap between the first and second fixing portions is located on the unsealing member in the longitudinal direction of the unsealing member.

32. The developer container according to claim 31, wherein the first fixing portion, the gap and the second fixing portion are arranged in this order in the longitudinal direction of the unsealing member.

* * * * *